US005157955A

United States Patent [19]

Hawkes et al.

[11] Patent Number: 5,157,955

[45] Date of Patent: Oct. 27, 1992

[54] CONTINUOUS EXTRUSION APPARATUS

[75] Inventors: Daniel J. Hawkes, Ashford; Douglas E. Anderson, Canterbury; Phillip A. Jones, Ashford, all of England

[73] Assignee: BWE Limited, England

[21] Appl. No.: 659,358

[22] PCT Filed: Jul. 6, 1990

[86] PCT No.: PCT/GB90/01043

§ 371 Date: Mar. 11, 1991

§ 102(e) Date: Mar. 11, 1991

[87] PCT Pub. No.: WO91/00783

PCT Pub. Date: Jan. 24, 1991

[30] Foreign Application Priority Data

Jul. 10, 1989 [GB] United Kingdom ..... 8915769

[51] Int. Cl.[5] ..... B21C 29/04

[52] U.S. Cl. ..... 72/262

[58] Field of Search ..... 72/262, 467

[56] References Cited

U.S. PATENT DOCUMENTS 3,457,760 7/1969 Cassady et al. ..... 72/467
4,598,567 7/1986 Backus ..... 72/262
4,823,586 4/1989 Sinha et al. ..... 72/262

FOREIGN PATENT DOCUMENTS 0125788 11/1984 European Pat. Off. .
0127924 12/1984 European Pat. Off. .
0233064 8/1987 European Pat. Off. .
0244254 11/1987 European Pat. Off. .
2103527 2/1983 United Kingdom .

*Primary Examiner*—Lowell A. Larson
*Attorney, Agent, or Firm*—Shlesinger, Arkwright & Garvey

[57] ABSTRACT

Continuous extrusion apparatus (FIG. 1) including a rotatable, grooved, wheel 2 is provided with a shoe 6 mounted on a pivot 7 to be rotatable between a position engaging the wheel 2 and a dis-engaged position. The shoe 6 carries a tooling cartridge 10 including an abutment block 14, an expansion block 16, a die block 18 and an exit block 20 connected together with bolts 22 and held in position by locking keys 46 and a retaining ring 50. A reciprocable ram 60 registers with the cartridge 10 when the shoe 6 is in the dis-engaged position and is operable to raise a cartridge 10 from an associated heating chamber 56 into the shoe 6 or to lower a cartridge 10 from the shoe 6 into a storage chamber (not shown). By utilizing a cartridge 10, change-over and pre-heating of sets of dies is facilitated, enabling the apparatus to be connected directly to a continuous casting furnace (not shown).

7 Claims, 3 Drawing Sheets

CONTINUOUS EXTRUSION APPARATUS

DESCRIPTION

This invention relates to apparatus for the forming of metals by a continuous extrusion process in which feed stock is introduced into a circumferential groove in a rotating wheel to pass into a passageway formed between the groove and arcuate tooling extending into the groove. The tooling includes an aperture formed in a shoe portion and extending in a generally radial direction from the groove to a die and an abutment is provided to constrain the feedstock to flow through the aperture and the die.

In GB-A-0125788 there is described continuous extrusion apparatus including a rotatable wheel having a plurality of spaced apart circumferential grooves, and provided with arcuate tooling with a shoe portion bounding radially outer portions of the respective grooves formed with exit apertures extending in a generally radial direction from the respective grooves to a chamber and abutments displaced in the direction of rotation of the wheel from the apertures extending into the grooves, the chamber discharging to a die orifice.

In a continuous extrusion apparatus of the form set out, according to one aspect of the invention the tooling includes an entry block positioned in a recess in the shoe portion bounding the grooves together with an abutment block, an expansion block, a die block and an exit block, the abutment block, expansion block and exit block being serially positioned in a stepped bore in the shoe portion with the abutment block seating upon a shoulder in the bore adjacent the entry block and means being provided to secure the exit block axially of the bore.

Preferably, the abutment block extends through an aperture in the entry block of generally frusto-conical form and flat faces formed on abutting, otherwise frusto-conical, faces co-act angularly to locate the abutment block relative to the entry block.

Desirably, a divergent expansion chamber extending through the expansion block includes an initial section and an outlet section each of frusto-conical form with the outlet section having a greater cone angle than the cone angle of the initial section.

Suitably, the means securing the exit block axially of the bore include locking keys moveable between an engaged position effecting secural and a disengaged position allowing removal of the exit block. Additionally, a retaining ring may be threaded into an end of the bore remote from the wheel to bear against the locking keys in an engaged position.

In another embodiment of the invention, the abutment block, the expansion block, the die block and the exit block are disconnectably secured together to form a tooling cartridge removable from and insertable into the bore as a whole and a heating chamber is provided adapted to effect heating of the tooling cartridge prior to insertion into the bore.

Advantageously, the tooling cartridge is insertable into and removable from the bore by actuation of a reciprocable ram aligned with the bore.

In a further embodiment of the invention, a continuous casting furnace is arranged to discharge cast feedstock direct to the circumferential grooves.

Suitably, the cast feedstock is discharged through a tunnel from the continuous casting furnace to the circumferential grooves. The tunnel may be lined with heat insulating material and may be arranged to be supplied with gases having little or no oxygen content.

The invention will now be described, by way of example, with reference to the accompanying, partly diagrammatic drawings, in which.

Figure 1:
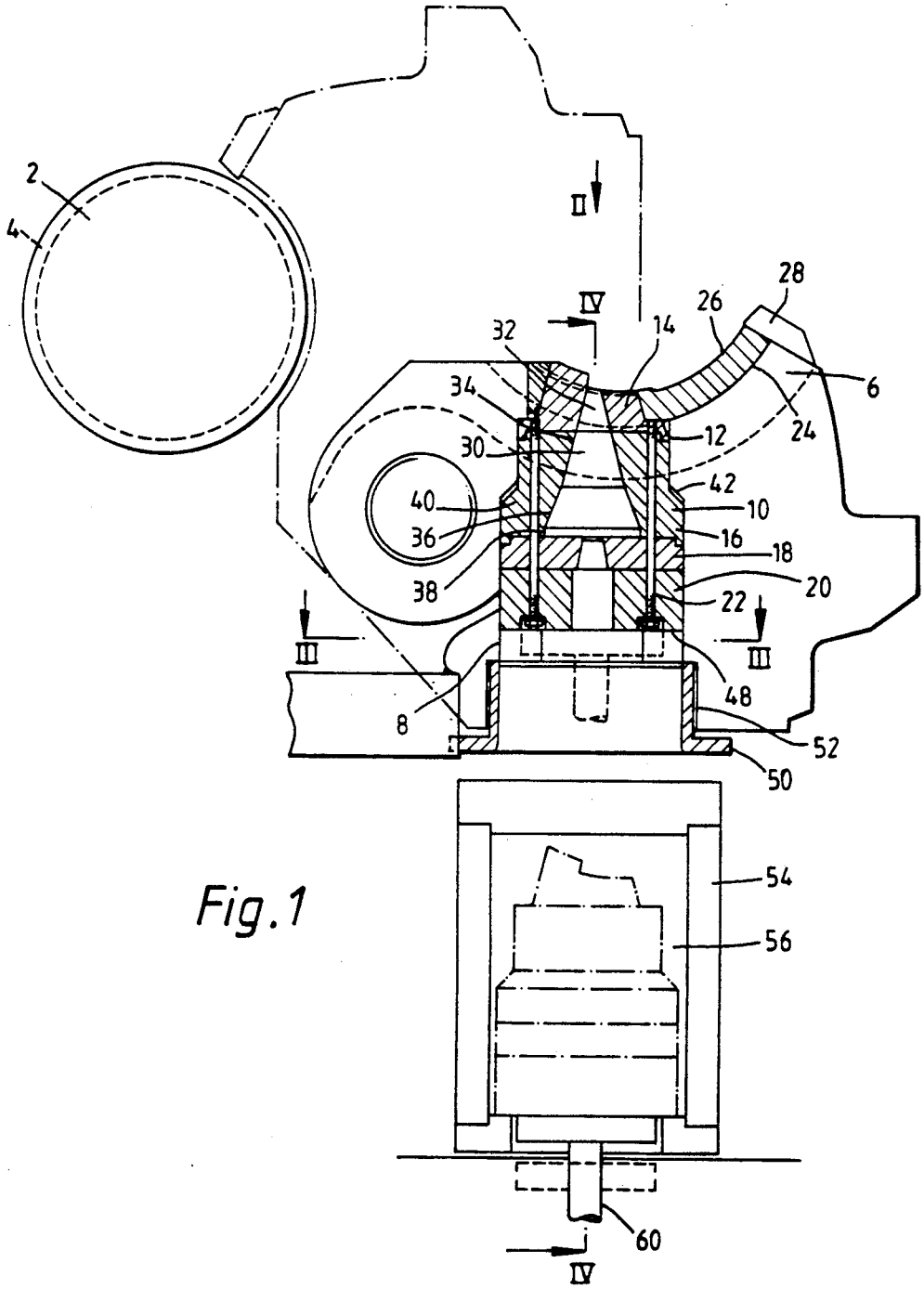
FIG. 1 is a cross-sectional side elevation of a continuous extrusion apparatus, indicating a shoe and associated tooling in a position dis-engaged from a rotatable, grooved, wheel, the engaged position being indicated in chain dotted outline, together with an associated heating chamber and a portion of a ram.
Figure 2:
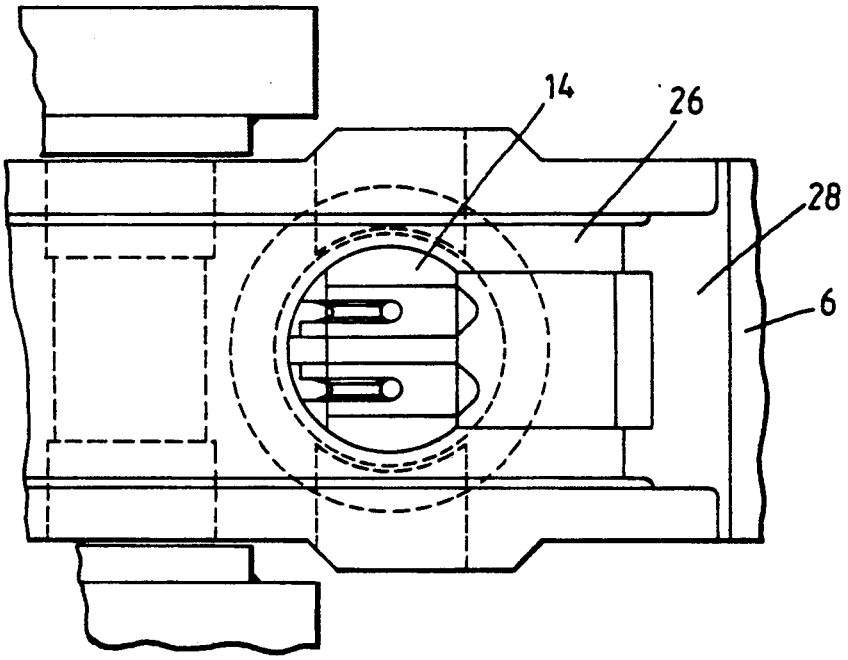
FIG. 2 is a plan view taken in the direction of the arrow II on FIG. 1.
Figure 3:
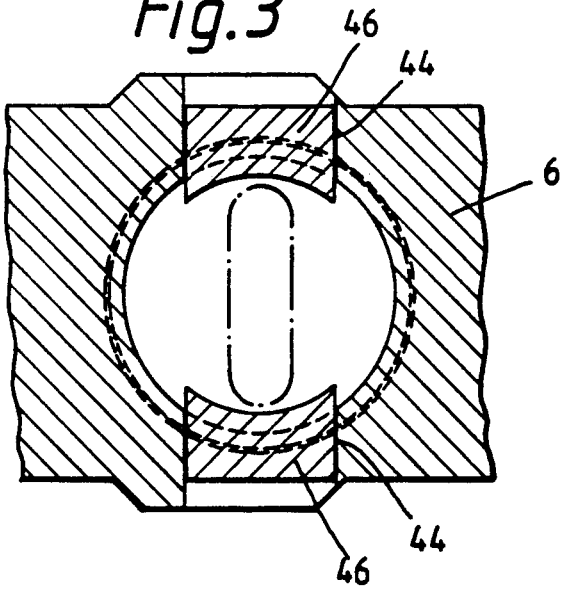
FIG. 3 is a cross-section taken on the line III—III of FIG. 1.
Figure 4:
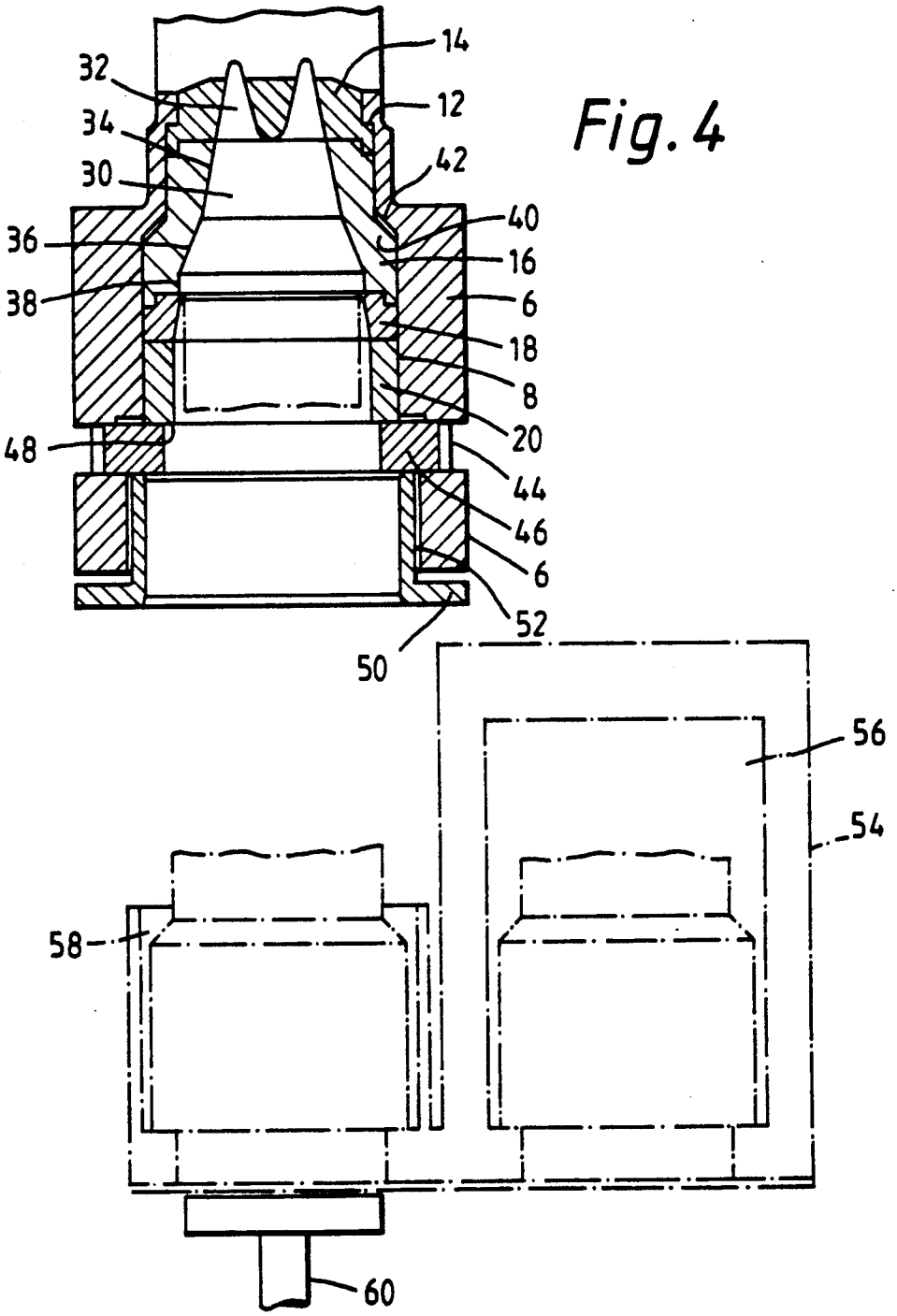
FIG. 4 is a cross-section taken on the line IV—IV of FIG. 1.

As shown in the accompanying drawings, a wheel 2 of a continuous extrusion machine is formed with a pair of axially spaced circumferential grooves 4. A shoe 6 mounted on a pivot 7 and rotatable to co-act with the wheel is formed with a stepped bore 8 into which a tooling cartridge 10 is inserted to seat on a shoulder 12. The tooling cartridge 10 includes an abutment block 14, an expansion block 16, a die block 18 and an exit block 20 connected together by bolts 22 threaded into the abutment block 14. A recess 24 in the shoe 6 registering with the bore 8 carries an entry block 26 mating with the abutment block 14 and is retained in position by a spring loaded clamp 28. Flat faces (not shown) on the entry block 26 and the abutment block 14 co-act angularly to locate the blocks the one relative to the other. The expansion block 16 is penetrated by a divergent expansion chamber 30 registering with entry passages 32 of frusto-conical form in the abutment block, an initial portion of the expansion chamber 30 having a frusto-conical wall 34 of the same cone angle as that of the entry passages 32, the form of the entry passages being modified to merge smoothly together and into the expansion chamber 30. An outlet portion of the expansion chamber is formed with a frusto-conical wall 36, of slightly greater cone angle than that of the wall 34, and a short cylindrical wall 38 at the outlet. To accommodate the divergent form of the expansion chamber 30, the expansion block 16 is of stepped outer diameter having a step 40, with a corresponding step 42 being provided in the bore 8 but spaced axially from the step 40 to ensure that the tooling cartridge 10 seats only on the shoulder 12.

The shoe 6 is formed with a pair of slots 44, intersecting with the bore 8 and is provided with radial locking keys 46 which, in an inserted position, bear against an outer face 48 of the exit block 20. A retaining ring 50 is threaded into a counter-bore 52 to bear against the locking keys 46 such that, upon tightening the retaining ring against the locking keys, the tooling cartridge 10 is urged to seat firmly upon the shoulder 12.

A sliding unit 54 is positioned below the shoe 6 in register with the bore 8 and includes a heating chamber 56 and a storage chamber 58 for tooling cartridges 10. A hydraulic ram 60 positioned co-axially of the bore 8 is actuable to move the tooling cartridges 10 between the sliding unit 54 and the bore 8, the retaining ring 50 being slacked-off and the locking keys 46 withdrawn to permit passage of the tooling cartridge.

To assembly a tooling cartridge 10 into the bore 8 in the shoe 6, appropriate sizes and forms of the abutment block 14, expansion block 16, die block 18 and exit block 20 are selected and secured together by the bolts 22, abutting dished and stepped end faces facilitating the operation and formation of a sealed junction. The assembled tooling cartridge 10 is then placed in a heating chamber 56 and heated to raise the temperature of the cartridge to a temperature approximating to working temperature. Upon the cartridge 10 reaching the requisite temperature, the hydraulic ram 60 is actuated to raise the cartridge into the bore 8 and to engage the flat faces on the abutment block 14 with the corresponding faces on the entry block 26 previously positioned in the recess 24 of the shoe 6. The radial locking keys 46 are then moved to the inserted position, the hydraulic ram retracted and the retaining ring 50 tightened onto the locking keys 46. The shoe 6 is then swung on the pivot 7 into engagement with the wheel 2 (as indicated in broken outline) whereupon, upon feedstock being fed to the groove 4 and the wheel driven, continuous extrusion may be commenced with a minimum of wastage.

To substitute a different die, the machine is stopped and the shoe swung to the open position shown in FIG. 1. The retaining ring 50 is then slacked off, the storage chamber 58 of the sliding unit 54 aligned with the bore 8, the hydraulic ram 60 actuated to engage the exit block and the locking keys 46 moved to a withdrawn position. The hydraulic ram 60 is then actuated to lower the tooling cartridge 10 into the storage chamber 58, the sliding unit indexed along to bring the replacement tooling cartridge 10, preheated to the operating temperature of the wheel 2 in the heating chamber 56, into alignment with the bore 8 whereupon the hydraulic ram is actuated to position the replacement tooling cartridge in the bore 8 as previously described with a minimal loss of down-time.

Such an arrangement lends itself to deriving feedstock from a continuous casting furnace since die changes may be effected rapidly and, since the die and associated tooling are pre-heated, little time need be lost in re-commencing extrusion, so that the build-up in molten feedstock may be accommodated in the continuous casting furnace. By casting feedstock from a continuous casting furnace and feeding over a shortest possible distance, through a tunnel having a wall of insulation material to reduce heat losses, direct to the continuous extrusion apparatus, the heat stored in the feedstock immediately following solidification is conserved and surface oxidation minimised. In situations where it is desired to avoid surface oxidation, output from the continuous casting furnace is fed through a tunnel of gases of reduced, or substantially no, oxygen content.

It will be appreciated that whilst a die for extruding a solid strip product has been illustrated, a full range of die producing solid or hollow products may be utilised.

We claim:

1. Continuous extrusion apparatus, comprising:

a) a rotatable wheel having a plurality of spaced apart circumferential grooves;

b) arcuate tooling with a shoe portion bounding radially outer portions of the respective grooves formed with exit apertures extending in a generally radial direction from the respective grooves to a chamber;

c) abutments displaced in the direction of rotation of the wheel from the apertures extending into the grooves, the chamber discharging to a die orifice;

d) the tooling comprising an entry block positioned in a recess in the shoe portion bounding the grooves, an abutment block, an expansion block, a die block and an exit block;

e) the abutment block, expansion block, die block and exit block are serially positioned in a stepped bore in the shoe portion;

f) the abutment block engaging upon a shoulder in the bore adjacent the entry block;

g) means for securing the exit block axially of the bore;

h) the abutment block extending through an aperture in the entry block of generally frusto-conical form;

i) flat faces formed on abutting faces of the abutment block and the entry block co-acting angularly to locate the abutment block relative to the entry block;

j) the abutment block, the expansion block, the die block and the exit block are disconnectably secured together to form a tooling cartridge;

k) a heating chamber and a storage chamber each arranged to accommodate the tooling cartridge are movably positioned to be indexed alternately into register with the bore at an open position of the shoe;

l) a support ram is reciprocable through the respective heating or storage chamber when indexed into registration with the bore to effect support of the tooling cartridge;

m) the tooling cartridge is removable from and insertable into the bore as a whole supported on the support ram; and n) the heating chamber is adapted to effect heating of the tooling cartridge prior to insertion into the bore.

2. Continuous extrusion apparatus as claimed in claim 1, characterised in that a divergent expansion chamber (30) extending through the expansion block (16) includes an initial section and an outlet section (36) each of frusto-conical form with the outlet section (36) having a greater cone angle than the cone angle of the initial section (34).

3. Continuous extrusion apparatus as claimed in claim 1, characterised in that the means securing the exit block axially of the bore include locking keys (46) moveable between an engaged position effecting secural and a disengaged position allowing removal of the exit block (20).

4. Continuous extrusion apparatus as claimed in claim 3, characterised in that a retaining ring (50) is threaded into an end of the bore (8) remote from the wheel (2) to bear against the locking keys (46) in an engaged position.

5. Continuous extrusion apparatus as claimed in claim 1, characterised in that a continuous casting furnace is arranged to discharge cast feedstock direct to the circumferential grooves (4).

6. Continuous extrusion apparatus as claimed in claim 5, characterised in that the cast feedstock is discharged through a tunnel from the continuous casting furnace to the circumferential grooves (4).

7. Continuous extrusion apparatus as claimed in claim 6, characterised in that the tunnel is lined with heat insulating material and is arranged to be supplied with gases having little or no oxygen content.

* * * * *